United States Patent [19]

Black et al.

[11] 4,161,133

[45] Jul. 17, 1979

[54] LIQUID PROPELLANT GUN

[75] Inventors: William L. Black, China Lake; Robert A. Gould, Ridgecrest; Stanley E. Wood, Inyokern, all of Calif.

[73] Assignee: The United States of America as represented by the Secretary of the Navy, Washington, D.C.

[21] Appl. No.: 921,527

[22] Filed: Jul. 3, 1978

Related U.S. Application Data

[63] Continuation-in-part of Ser. No. 774,366, Mar. 4, 1977, abandoned.

[51] Int. Cl.[2] ..... F41F 1/04
[52] U.S. Cl. ..... 89/7
[58] Field of Search ..... 89/7, 1 R

[56] References Cited

U.S. PATENT DOCUMENTS

| | | | |
|---|---|---|---|
| 2,947,221 | 8/1960 | Griffin et al. | 89/7 |
| 2,981,153 | 4/1961 | Wilson et al. | 89/7 |
| 3,138,990 | 6/1964 | Jukes et al. | 89/7 |
| 3,576,103 | 4/1971 | Kahn | 89/7 X |
| 3,763,739 | 10/1973 | Tassie | 89/7 |
| 3,783,737 | 1/1974 | Ashley | 89/7 |
| 3,992,976 | 11/1976 | Bartels et al. | 89/7 |
| 4,005,632 | 2/1977 | Holtrop | 89/7 |
| 4,023,463 | 5/1977 | Tassie | 89/7 |
| 4,037,995 | 7/1977 | Graham | 89/7 UX |
| 4,050,352 | 9/1977 | Tassie | 89/7 |

*Primary Examiner*—David H. Brown
*Attorney, Agent, or Firm*—R. S. Sciascia; W. Thom Skeer; John H. Lynn

[57] ABSTRACT

A liquid propellant gun and gun loading process wherein a predetermined amount of a gas is intimately mixed with the propellant charge.

12 Claims, 6 Drawing Figures

LIQUID PROPELLANT GUN

CROSS REFERENCE TO RELATED APPLICATION

This application is a continuation-in-part of application Ser. No. 774,366, filed Mar. 4, 1977, now abandoned for "Liquid Propellant Gun".

BACKGROUND OF THE INVENTION

The present invention relates to bulk loaded liquid propellant guns of a type wherein a liquid propellant is injected into the chamber of the gun between the projectile and the bolt. Method and apparatus are provided for use in liquid propellant guns such as that described assignee's prior application, Ser. No. 612,817 filed Sept. 12, 1975, now U.S. Pat. No. 3,992,976.

Many prior art devices have, of course, used liquid and gas mixtures to form an explosive or propellant. U.S. Pat. No. 424,119 uses a small amount of gasoline with compressed air and U.S. Pat. No. 3,567,103 uses a fuel and a gas which will fire by compression. In contrast to this type of weapon, however, the bulk loaded liquid propellant gun effort has concentrated on the injection of a liquid or liquids into the propellant chamber in ways designed to eliminate as much as possible any space between the bolt and the projectile. Any introduction of air was accidental or incidental and was, therefore, uncontrolled. It has been found that a gun which fills the entire space between the bolt and the projectile with a liquid propellant is prone to catastrophic pressure increases and uncontrolled burning. A prior art liquid propellant gun uses this detonation by compression as a means for initiating combustion of the propellant as shown in U.S. Pat. No. 2,947,221. Accordingly, present research has centered upon ways of decreasing peal pressure and producing uniform burning of propellants.

Some prior art guns utilize hypergolic propellants injected into a large chamber while others ignite a stream of propellant injected in to a chamber such as that in U.S. Pat. No. 4,037,995. The invention is applicable to bulk loaded liquid propellant guns which inject a propellant into a space between a bolt and projectile then ignite the propellant after the completion of the injection cycle.

SUMMARY OF THE INVENTION

Accordingly, the present invention intentionally provides a measured amount of space between the bolt and projectile and injectors situated in such a way as to provide a dispersion of very small gas bubbles within the liquid propellant to make the charge of the gun somewhat compressible, which prevents predetonation and insures even burning when the liquid propellant is fired.

DESCRIPTION OF THE PREFERRED EMBODIMENT

Figure 1:
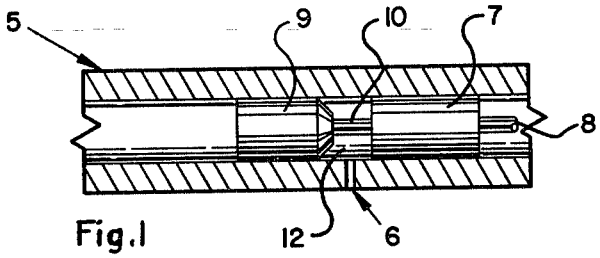
FIG. 1 is a partial, longitudinal cross-sectional view of a liquid propellant gun in the breech area, with parts in position for charging with propellant.

Pictured in FIG. 1 of the drawing is breach area 5 of a liquid propellant gun having an opening 6 through which a propellant may be injected between a bolt 7 and a projectile 9. Bolt 7 is illustrated with a bolt actuator 8, and the projectile is illustrated with a pin 10 projecting from the base. Pin 10 is dimensioned so as to maintain a measured distance between bolt 7 and projectile 9 to provide a space between bolt 7 and projectile 9 in a chamber 12. In the preferred embodiment this space is between two and ten percent of the fluid volume of propellant and gas at the completion of injection. If less than two percent of the fluid volume is taken up by this space the peak pressure of the gun will be too high and uneven burning will result. If more than ten percent of the volume is taken up by gas, the ignition of the propellant will be erratic. The final volume is less than the sum of propellant and gas volumes thus putting the gas under pressure. The preferred embodiment has a final volume of 97% of the gas and propellant volume.

Figure 2:
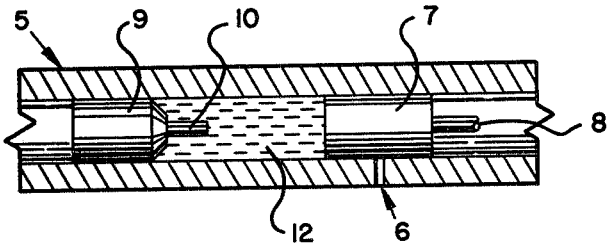
FIG. 2 shows the liquid propellant gun of FIG. 1 with the parts in position for firing.

When a premeasured volume of propellant is injected through opening 6 into chamber 12, projectile 9 is forced away from bolt 7 until injection of the propellant stops. After the injection ceases, bolt 7 is moved forward by bolt actuator 8 to the position shown in FIG. 2 blocking opening 6 and, because of the relative incompressibility of the propellant charge, also moving projectile 9 forward into the gun barrel. The injection of the propellant must be at such a rate as to produce dissemination of the gas present in the space betweeen the bolt and projectile within the mass of injected propellant. It has been found that the gas must be dispersed into small bubbles of less than 0.001 inch in diameter. If the bubbles are larger, the bubbles will produce secondary ignition points on ignition of the propellant mass, resulting in uneven burning and catastrophic pressure rises.

The general parts shown in the sequence of events described are all known to the prior art. The intentional introduction of a controlled amount of space between the bolt and projectile filled with a gas by the use of a spacer 10, for example, provides a new and different method and apparatus for effective control of the burning characteristics of the liquid propellant when the gun is fired. It should be noted that the percent of gas and bubble size are important paramaters and that the desired characteristic would not result from any accidental space left between a projectile and bolt other than by coincidence.

Figure 3:
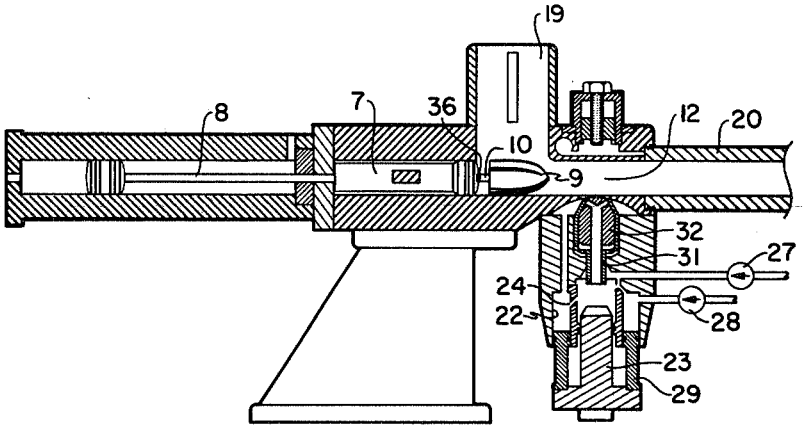
FIGS. 3, 4, and 5 are views of a prior art liquid propellant gun with the invention added to show the invention in a working environment.

FIG. 3 shows the invention in a working environment. The Liquid Propellant gun is identical to that used in U.S. Pat. No. 3,992,976. In this embodiment the only addition is pin 10 to projectile 9. Fuel and oxidizer enter through valves 27, 28 into cylinders 22, 24 which contain pistons 23, 29 to inject fuel and oxidizer into a chamber 12. In FIG. 3 the bolt 7 is in the loading position and projectile 9 has entered from a magazine 19.

Figure 4:
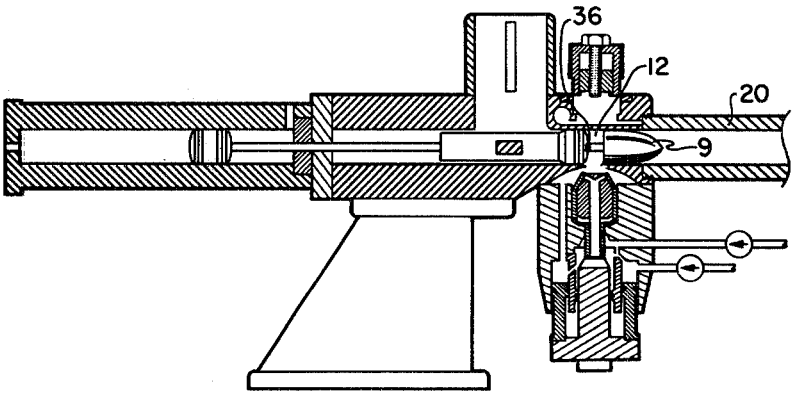

FIG. 4 shows the gun in position for injection of propellant. Bolt 7 is pushed forward by actuator 8 and valve 32 is open, allowing the injection of propellant through a port 31. Pistons 23, 29 are injecting the propellants. The propellants mix with the gas in chamber 12 so that the gas is dispersed within the propellant in small bubbles.

Figure 5:
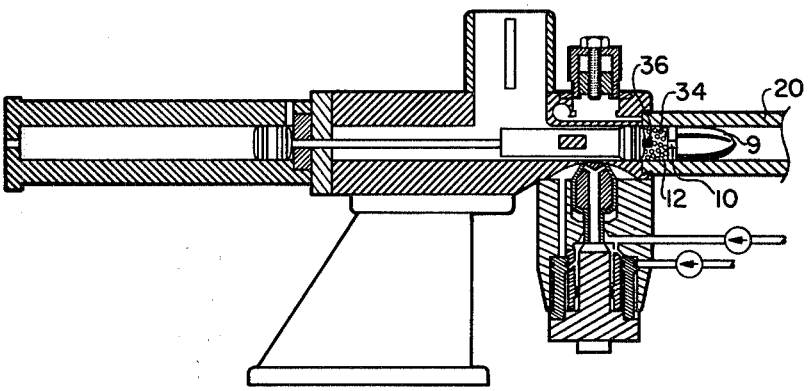

FIG. 5 shows the gun in firing position. Bolt 7 is fully advanced. Valve 32 is closed. Gas bubbles 34 are dispersed within the propellant. A spark plug 36 in bolt 7 ignites the propellant to fire the gun.

Figure 1A:
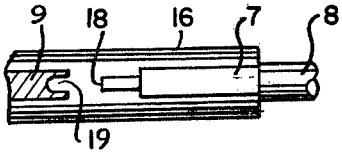
FIG. 1*a* is an alternate configuration for the bolt.

Although a single embodiment of the invention is illustrated, it will be understood that other and further modifications may be resorted to without departing from the spirit of the invention. FIG. 1A shows an embodiment of the invention wherein the desired volume of gas is retained in chamber 12 by having a projection 18 on the forward end of bolt 7 and a depression 19 in the rear of projectile 9. The crucial feature is the percentage of space filled with gas and a geometry that will insure the production of gas bubbles of the requisite small size.

In test firings of liquid propellant guns, it has been found that following the disclosed method resulted in lower peak chamber pressures. That is, when the propellant was first ignited, the pressure within the chamber did not build up to as high a peak as it did in cases where the chamber was completely filled with a liquid propellant. The gas in chamber 12 between bolt 7 and projectile 9 may be either air, gaseous products of the combustion of the liquid propellant, or propellant vapors. The desirable characteristics of the gas bubbles are thus apparently due to physical rather than chemical effects.

It will be apparent that the embodiment shown is only examplatory in that various modifications in construction and arrangement may be made without departing from the scope of the invention as defined in the subjoined claims.

What is claimed is:

1. A bulk loaded liquid propellant gun utilizing a liquid propellant for firing a projectile from a barrel comprising:

an elongated barrel;

a bolt within said barrel movable between loading and firing positions to load said barrel and to seal the rear thereof;

a projectile within said barrel forward of said bolt;

a depression on the rear of said projectile to provide a void between said bolt and said projectile;

a gas filling said void;

an injection port in said barrel communicating to said void while said bolt is in loading position and sealed by said bolt while in firing position;

ignition means in said barrel between said bolt and said projectile while said bolt is in firing position to ignite said liquid propellant; and compression means to place said liquid propellant and said gas at a pressure greater than atmospheric pressure.

2. A bulk loaded liquid propellant gun as described in claim 1 wherein said gas is air.

3. A bulk loaded liquid propellant gun as described in claim 1 wherein said gas comprises gaseous products of combustion of said liquid propellant.

4. A bulk loaded liquid propellant gun as described in claim 1 wherein said gas comprises propellant vapors.

5. A bulk loaded liquid propellant gun utilizing a liquid propellant for firing a projectile from a barrel comprising:

an elongated barrel;

a bolt within said barrel movable between loading and firing positions to load said barrel and to seal the rear thereof;

a projectile within said barrel forward of said bolt;

a projection on said bolt to provide a void between said bolt and said projectile;

a gas filling said void;

an injection port in said barrel communicating to said void while said bolt is in loading position and sealed by said bolt while in firing position;

ignition means in said barrel between said bolt and said projectile while said bolt is in firing position to ignite said liquid propellant; and compression means to place said liquid propellant and said gas at greater than atmospheric pressure.

6. A bulk loaded liquid propellant gun as described in claim 5 wherein said gas is air.

7. A bulk loaded liquid propellant gun as described in claim 5 wherein said gas comprises gaseous products of combustion of said liquid propellant.

8. A bulk loaded liquid propellant gun as described in claim 5 wherein said gas comprises propellant vapors.

9. A bulk loaded liquid propellant gun utilizing a liquid propellant for firing a projectile from a barrel comprising:

an elongated barrel;

a bolt within said barrel movable between loading and firing positions to load said barrel and to seal the rear thereof;

a projectile within said barrel forward of said bolt;

a projection on the rear of said projectile to provide a void between said bolt and said projectile;

a gas filling said void;

an injection port in said barrel communicating to said void while said bolt is in loading position and sealed by said bolt while in firing position;

ignition means in said barrel between said bolt and said projectile while said bolt is in firing position to ignite said liquid propellant and compression means to place said liquid propellant and said gas at a pressure greater than atmospheric pressure.

10. A bulk loaded liquid propellant gun as described in claim 9 wherein said gas is air.

11. A bulk loaded liquid propellant gun as described in claim 9 wherein said gas comprises gaseous products of combustion of said liquid propellant.

12. A bulk loaded liquid propellant gun as described in claim 9 wherein said gas comprises propellant vapors.

* * * * *